United States Patent [19]

Turner

[11] Patent Number: 4,906,058

[45] Date of Patent: Mar. 6, 1990

[54] STORAGE UNIT

[76] Inventor: Robert A. Turner, 17 E. Berridge Ln. Rear, Phoenix, Ariz. 85016

[21] Appl. No.: 158,944

[22] Filed: Feb. 22, 1988

[51] Int. Cl.[4] ..... A47B 67/02

[52] U.S. Cl. ..... 312/245; 211/70.8; 285/7; 285/921; 285/192

[58] Field of Search ..... 312/286, 245, 281, 140.4; 211/70.8, 60.1, 13; 285/7, 921, 192, 208, 319; 246/65, 68.1, 304

[56] References Cited

U.S. PATENT DOCUMENTS

| | | | |
|---|---|---|---|
| 346,201 | 2/1886 | Hibarger | 312/281 X |
| 362,678 | 8/1887 | Steel | 312/281 |
| 544,055 | 8/1895 | Smith | 312/280 X |
| 562,727 | 6/1896 | Hooper | 312/280 |
| 1,951,894 | 3/1934 | Ziebarth | 211/13 |
| 1,981,674 | 11/1934 | Soloman | 312/281 |
| 2,177,153 | 10/1939 | Ross | 280/61 |
| 2,450,729 | 9/1948 | Stoner | 211/86 |
| 2,549,349 | 8/1949 | Wahlstrom | 211/13 |
| 2,660,457 | 11/1953 | Mallon | 285/7 |
| 2,738,990 | 3/1956 | Hill | 285/192 X |
| 3,165,367 | 1/1965 | Rose | 312/281 X |
| 3,181,756 | 5/1965 | Smilg | 211/13 |
| 3,215,882 | 2/1973 | Ohde | 312/245 X |
| 3,289,851 | 12/1966 | Federman | 211/4 |
| 4,114,927 | 9/1978 | Butcher | 285/921 X |
| 4,352,337 | 10/1982 | Wyoral | 211/60.1 |
| 4,446,972 | 5/1984 | Sussman | 211/13 |

*Primary Examiner*—Joseph Falk

*Attorney, Agent, or Firm*—Don J. Flickinger; Jordan M. Meschkow; Lowell W. Gresham

[57] ABSTRACT

A cabinet includes a downturned arcuate top having an upstanding flange at the front edge and spaced apart upstanding support members at the rear edge. Elongate flexible items, such as sections of vacuum hose, are stored upon the top intermediate the flange and the support members. Cradles, carried by the support members, hold elongate rigid items, such as vacuum hose extensions and handle sections of various equipment. Cleaning heads and other attachments are engaged with and suspended from sockets formed in the bottom of the cabinet. Other items are held by hooks which depend from the cabinet. The cabinet is also provided with a shelf and lockable doors for storage of small items and toxic or poisonous materials.

15 Claims, 2 Drawing Sheets

FIG. 1
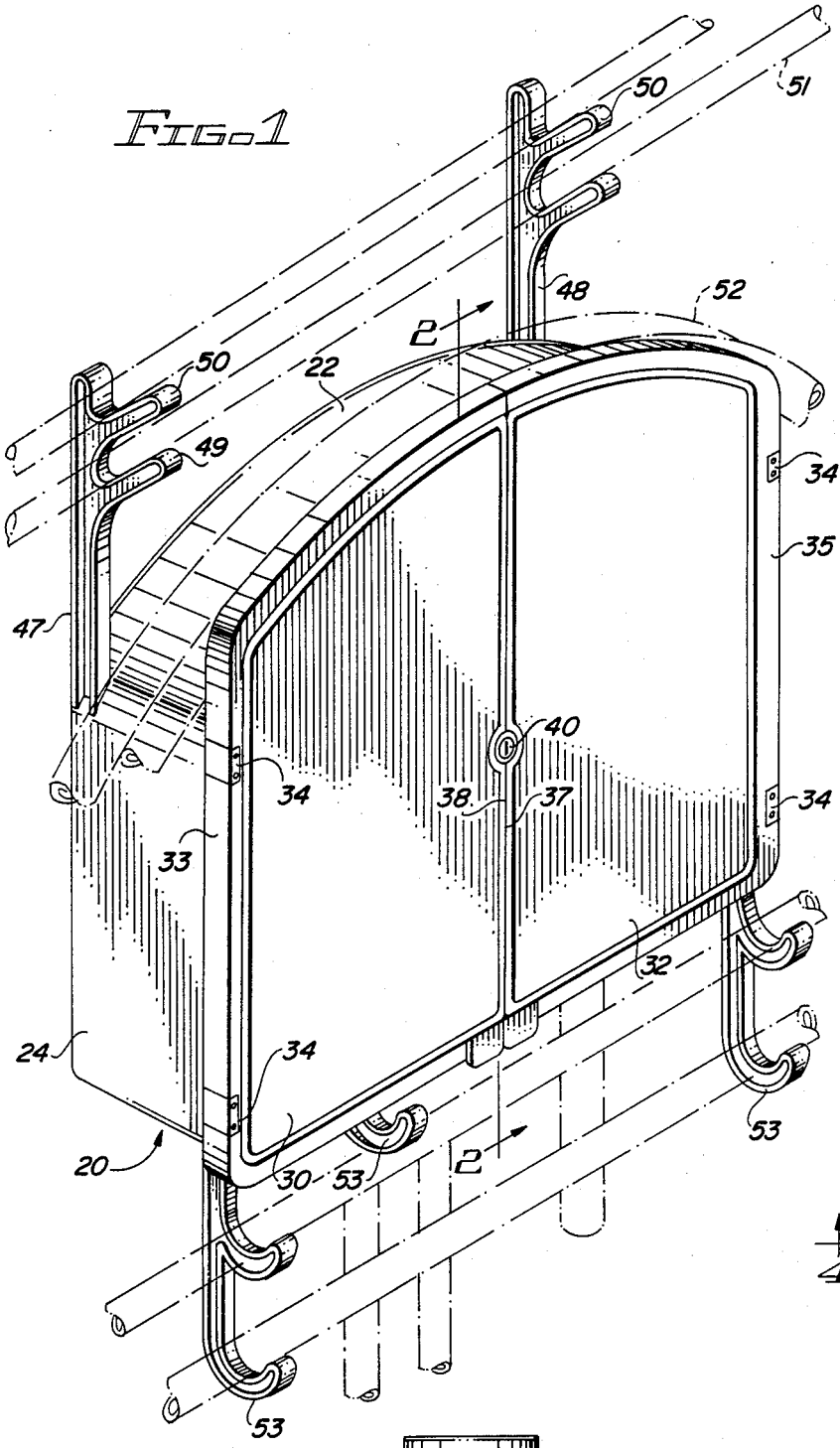
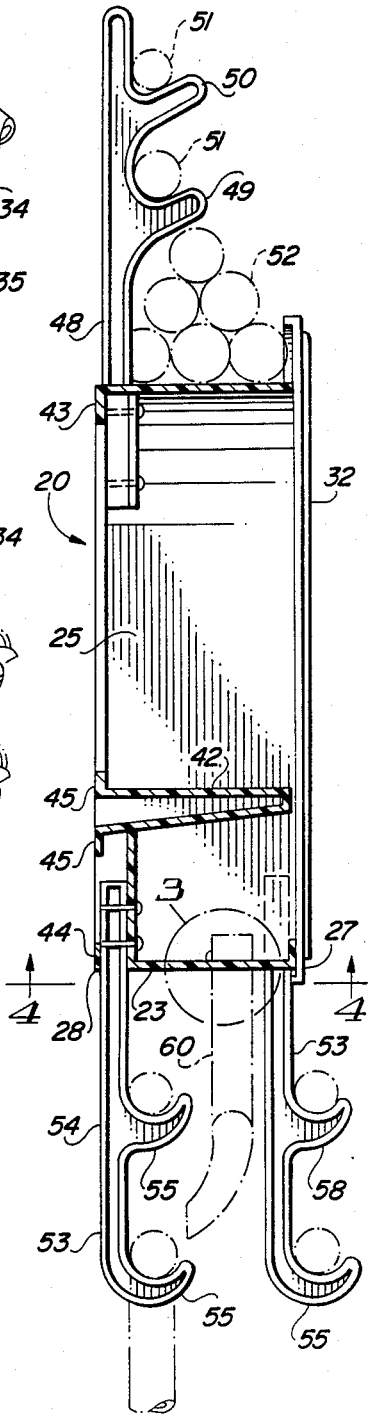
FIG. 2
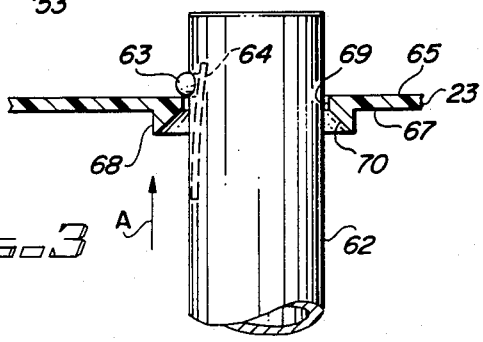
FIG. 3

STORAGE UNIT

BACKGROUND OF THE INVENTION

1. Field of the Invention

This invention relates to storage apparatus.

More particularly, the present invention relates to apparatus especially adapted for storing selected rigid and flexible items, as exemplified by the accessories and attachments commonly used in connection with maintenance and cleaning systems.

In a further and more specific aspect, the immediate invention concerns a storage unit having novel means for holding and displaying selected items for convenient selection and removal.

2. The Prior Art

The problems associated with the storage of certain familiar household items are well-known. An exemplary concern involves the supplies, accessories and attachments commonly used in connection with conventional maintenance and cleaning systems. Especially notable is the paraphernalia for tending water-filled structures, such as hot tubs, spas and swimming pools.

Maintenance of water, in a closed system, requires periodic application of usually toxic or poisonous chemicals. The chemicals, which may be in either dry or liquid form, are packaged in various types of containers. Various relatively large individual pieces of equipment are employed for removing debris from the water and for cleaning the structure. Typical is a skimmer having a rigid pole or shaft. A vacuum cleaning system includes an elongate flexible hose, one or more tubular handles or extension sections and an array of tools or attachments. Also usually included in the care and maintenance scheme is a collection of smaller items such as thermometers, water testing kits and hand tools.

Proper storage of the foregoing and other readily apparent accessories is mandatory for reasons of convenience, security and safekeeping. Chemicals, for example, must be secured from the inquisitive hands and mouths of children. Vacuum hoses, extensions and other relatively fragile items require care and protection. Safeguards against accidental loss or misplacement need be exercised with regard to small articles.

The prior art has not provided satisfactory means for orderly safekeeping of maintenance and cleaning supplies and equipment as described above. Therefore, the articles are frequently left lying about or deposited in whatever space is readily available. As a result chemicals are available to children, fragile components are exposed to damage and small items are subject to loss.

It would be highly advantageous, therefore, to remedy the foregoing and other deficiencies inherent in the prior art.

Accordingly, it is an object of this invention to provide improvements for the storage of certain maintenance and cleaning paraphernalia.

Another object of the invention is the provision of storage means especially adapted for orderly safekeeping of supplies and equipment commonly used in connection with water-filled structures, such as hot tubs, spas and swimming pools.

And another object of the invention is to provide a storage unit which will display selected accessory items for convenient selection.

Still another object of the present invention is the provision of a comprehensive storage unit which is usable either as a wall hanging device or as a free standing unit.

Yet another object of the invention is to provide a storage unit including a lockable cabinet for securing chemical or other toxic or poisonous materials.

Yet still another object of the invention is the provision of a storage device having novel means for engagably receiving and detachably holding a suspended array of selected accessory items.

And a further object of the instant invention is to provide means for convenient storage of hoses and other elongate flexible items.

Yet a further object of the invention is the provision of a unit having means for methodic protective storage of cleaning and maintenance devices of the type having an elongate pole, handle or tubular member.

Still a further object of the immediate invention is to provide a storage device which is alternately and concurrently usable as a shelf and for suspended storage of selected cleaning attachments.

And still a further object of the invention is the provision of improved storage means, according to the foregoing, which is readily and economically manufactured with conventional skills and materials.

SUMMARY OF THE INVENTION

Briefly, to achieve the desired objects of the instant invention in accordance with a preferred embodiment thereof, provided is a cabinet having a top and having first and second spaced apart upstanding retention means. An elongate flexible member, such as a vacuum hose, is received upon the top and held between the retention means. Preferably, the first and the second retention means are carried proximate the front side and the rear side, respectively, of the cabinet. More specifically, the top is generally arcuate having downturned terminal portions directed toward the respective sides of the cabinet. The first retention means may be in the form of a flange projecting above the top of the cabinet.

In accordance with a further embodiment, the second retention means includes support means for removably holding an elongate rigid member, such as a handle or extension section. More specifically, the support means may be in the form of a cradle carried by an upright support member for receiving and holding the elongate rigid member. Further included are hanger means depending from the cabinet. A preferred hanger means includes a generally hook-shaped element carried by a depending support member.

In accordance with a still further embodiment of the invention provided are coupling means carried by the cabinet for receiving and engagably holding the coupling portion of an attachment element of the type having a substantially rigid coupling portion with an outwardly biased detent element. Preferably, the cabinet includes a shelf having the coupling means integral therewith. A preferred coupling means is in the form of an opening in the shelf for receiving the coupling portion therethrough with the detent element projecting over the topside of a shelf. A removable element may be carried within the opening for substantial continuity of the topside of the shelf prior to initial receipt of the coupling portion therethrough. The removable element is supported within the l opening by frangible connection means.

BRIEF DESCRIPTION OF THE DRAWINGS

Further and more specific objects and advantages of the instant invention will be become readily apparent to those skilled in the art from the following detailed description of preferred embodiments thereof taken in conjunction with the drawings in which:

FIG. 1 is a perspective view of a storage unit constructed in accordance with the teachings of the instant invention, selected accessory items to be held and displayed thereby being shown in broken outline;

FIG. 2 is a vertical sectional view taken along the line 2—2 of FIG. 1;

FIG. 3 is an enlarged fragmentary sectional view taken from within the broken outline circle designated 3 in FIG. 2;

DETAILED DESCRIPTION OF THE PREFERRED EMBODIMENTS

Figure 4:
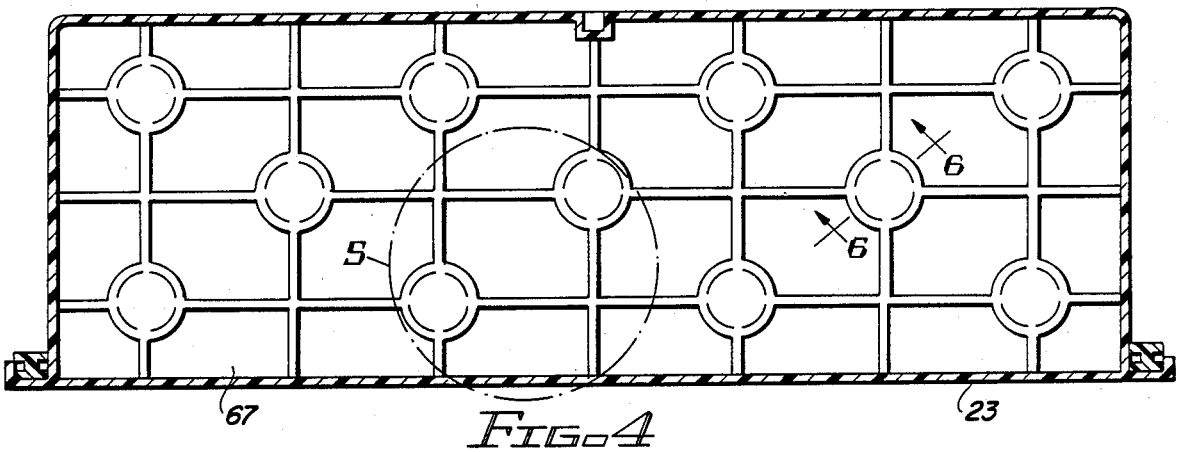
FIG. 4 is a horizontal sectional view taken along the line 4—4 of FIG. 2.

Turning now to the drawings in which like reference characters indicate corresponding elements throughout the several views, attention is first directed to FIG. 1 which illustrates a storage unit embodying the principles of the instant invention and in including a cabinet generally indicated by the reference character 20. As seen in additional detail with further reference to FIG. 2, cabinet 20 includes top 22, bottom 23, first lateral side 24 and second lateral side 25.

In accordance with the immediately preferred embodiment of the invention, bottom 23 is substantially planar and horizontal. First lateral side 24 and second lateral side 25, being preferably planar, extend substantially vertically upward from respective ends of bottom 23. Top 22 is generally arcuate having downturned terminal portions which are contiguous with respective ones of the lateral sides. The several contiguous elements define a parametric structure having front 27 and rear 28.

Outwardly projecting flange 29, of which further description will be made presently, encircles the parametric structure. Preferably, flange 29 is adjacent front 27. First door 30 and second door 32 form a selectively openable closure for the front 27 of cabinet 20. In accordance with conventional techniques, the outboard edge 33 of door 30 is pivotally affixed, as by hinges 34, to the upright portion of flange 29 adjacent first lateral side 24. Similarly, the outboard edge 35 of door 32 is hingedly affixed to the portion of flange 29 adjacent second lateral side 25. Inboard edge 37 of door 30 lies in juxtaposition with inboard edge 38 of door 32 when the doors are in the closed position as seen in FIG. 1. Further in accordance with standard practice, each of the doors 30 and 32 are provided with a handle 39 and secured in the closed position by a lock mechanism 40. Shelf 42 extends transverse of cabinet 20 between the lateral sides 24 and 25.

The embodiment of the invention herein chosen for purposes of illustration is especially adapted to be affixed to a wall or other vertical service which will function as the closure for rear 28 of cabinet 20. For this purpose, mounting flange 43 is carried by top 22 while mounting flange 44 is carried by bottom 23. As will be appreciated by those skilled in the art, mounting flanges 43 and 44 may be secured to the supporting surface by any standard means, such as mechanical fasteners or glue. Shelf 42 is similarly provided with mounting flanges 45. Alternately, the flanges 43, 44 and 45 may be eliminated in favor of a panel closing rear 28 and legs affixed to cabinet 20 to provide a free standing unit.

First elongate member 47 and second elongate member 48 project upwardly from top 22 of cabinet 20 at a location near rear 28. Preferably, member 47 resides adjacent first lateral side 24 while second member 48 resides adjacent second lateral side 25. A pair of spaced apart fingers 49 and 50 project upwardly forward from the upper portion of first elongate member 47. Corresponding fingers 49 and 50 are carried by upright member 48.

Top 22 of cabinet 20 provides storage for elongate flexible members, such as the vacuum hose shown in broken outline and designated by the reference character 52. Several folds or sections may be draped over top 22 as necessary to keep the flexible member from dragging upon the ground. Elongate members 47 and 48 and flange 29 function to retain the flexible member therebetween upon cabinet 20. For this reason, it is preferred that the section of flange 29 adjacent top 22 be of extended width. Each finger 49 and 50 cooperates with the respective upright member 47 and 48 to form a cradle for holding and displaying an elongate rigid member, shown in broken outline designated 51. Exemplary elongate rigid members are the handles associated with various items, such as cleaning pool skimmers, and the tubular extensions used in connection with vacuum hose 52. It is noted that members 47 and 48 support the cradles at an elevation which is sufficient to reside above several sections of vacuum hose 52, as specifically seen in FIG. 2.

Means for suspended or hanging storage of other paraphernalia is also carried by cabinet 20. In accordance with an immediately preferred embodiment of the invention, there are provided three hangers 53 which depend from cabinet 20. Each hanger 53 includes a depending support member 54 carrying a pair of spaced apart hook-shaped elements 55. While two hook-shaped elements 55 are shown as being carried by each depending support member 54 and two cradles are supported by each upright member 47 and 48, it will be appreciated by those skilled in the art that the number of each may be increased or decreased at the option of the manufacturer.

The instant invention also contemplates the orderly storage of attachment elements, such as the conventional cleaning devices detachably and interchangeably securable to the end of the tubular extension commonly used in connection with vacuum cleaning systems. The one or several attachment elements are suspended from cabinet 20 as seen with reference to the attachment element 60 illustrated in broken outline in FIG. 2. Referring additionally to FIG. 3, there is seen in further detail the coupling portion 62 of attachment element 60.

As will be readily understood by those skilled in the art, coupling portion 62 is a generally rigid tubular structure having a radially projecting detent element 63 which is outwardly biased as by leaf spring 64. Also seen in further detail is bottom 23 having top side 65 and underside 67. In the immediate area of engagement with attachment element 60, bottom 23 is reinforced by boss 68.

Cylindrical opening 69, assuming coupling portion 62 to be cylindrical, extends through bottom 23 including boss 68. The lower portion of opening 69 is outwardly downwardly tapered as by frustoconically beveled surface 70. The diameter of opening 69 is greater than the diameter of coupling portion 62 but less than the same measurement including detent element 63. As coupling element 62 is moved upwardly, in the direction indicated by arrowed line A, through opening 69 detent element 63 is urged inwardly by beveled surface 70 to pass through opening 69. After passing through opening 69, detent element 63 is urged radially outward in response to spring 64. Accordingly, attachment element 60 is engaged with bottom 23 with coupling element 62 projecting through opening 69 and detent element 63 resting upon topside 65. For removal of attachment member 60 from bottom 23, detent element 63 is depressed manually and the element withdrawn downwardly.

Figure 5:
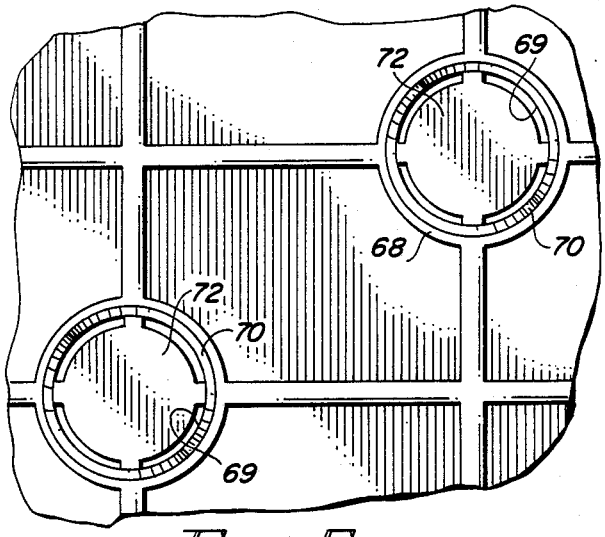
FIG. 5 is an enlarged fragmentary plan view taken from within the broken outline circle designated 5 in FIG. 4.
Figure 6:
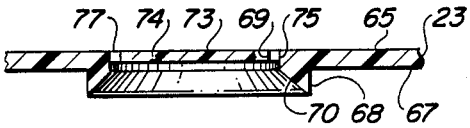
FIG. 6 is a fragmentary vertical sectional view taken along the line 6—6 of FIG. 4 and especially detailing the coupling means as it would appear prior to initial use.

FIG. 4 illustrates bottom 23 as it would initially appear prior to use for storage of an attachment element 60. As seen with further reference to FIG. 5, a plurality of openings 69 are spaced throughout. A removable element 72 is carried in each opening 69 for substantial continuity of top side 65. With further reference to FIG. 6, it is seen that removable element 72 includes plate 73 having top surface 74 which is substantially coplanar with surface 65 and a peripheral edge 75 which is spaced from opening 69. Relatively thin frangible fingers 77 extend between peripheral edge 75 and opening 69. As will be appreciated by those skilled in the art, bottom 23 having removable elements 72 integral therewith may be readily fabricated of various materials in accordance with conventional procedure, such as molded plastic.

Figure 7:
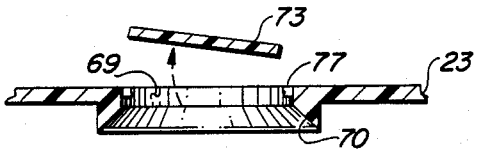
FIG. 7 is a view generally corresponding to the view of FIG. 6 and showing the coupling means with the removable element broken therefrom.

Top surface 65 of bottom 23 functions as a shelf for storage of selected items. Only so many elements 72 need be removed from the corresponding openings 69 as necessary to provide storage for the user's collection of attachment elements 60. To prepare a given opening 69 for use, plate 73 is readily removed in response to a sharp tap or pressure thereby severing the frangible fingers 77 as illustrated in FIG. 7.

Figure 8:
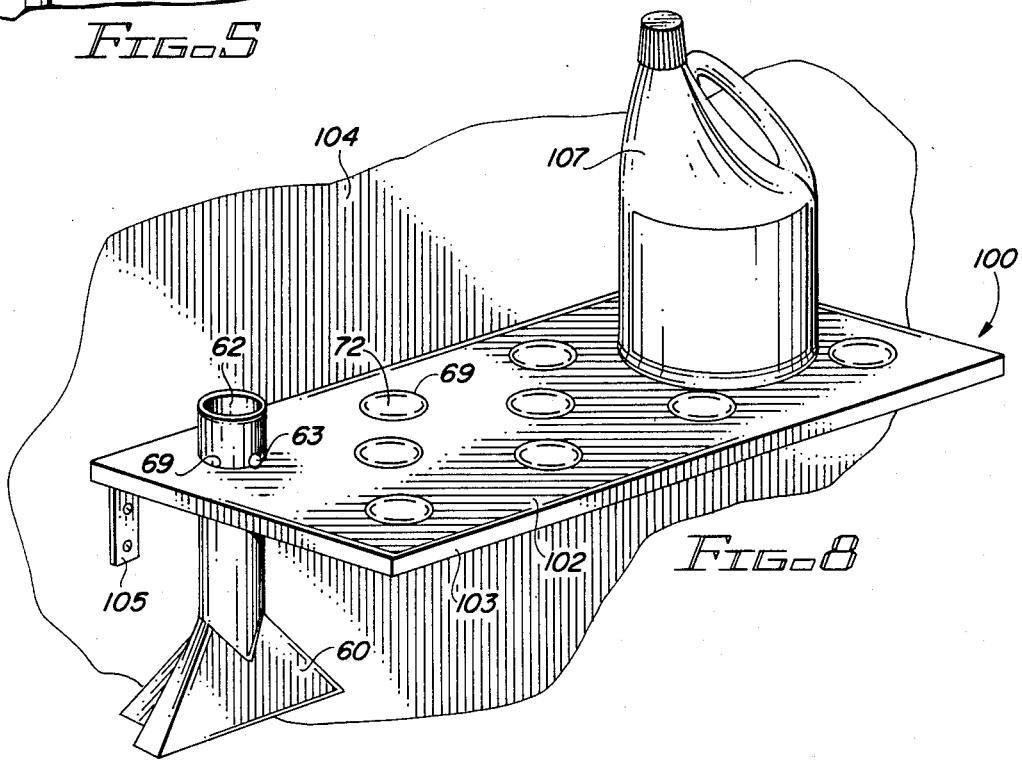
FIG. 8 is a perspective view of an alternate storage device incorporating the principles of the instant invention.

An alternate storage unit embodying the principles of the instant invention is seen with reference to FIG. 8. The immediate embodiment includes a generally rigid panel generally designated by the reference character 100 having top side 102 and bottom side 103 which is affixed to wall 104 by any conventional means such as commercially available angle or shelf brackets 105. Being substantially horizontal, panel 100 functions as a shelf for storage of selected items, such as illustrated by bottle 107, upon topside 102. A plurality of openings 69, each initially closed by removal element 72 extend though panel 100. For further details concerning panel 100, reference is made to FIGS. 3 through 7 and the associated description.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully disclosed and described the present invention and alternately preferred embodiments thereof, in such clear and concise terms as to enable those skilled in the art to understand and practice the same, the invention claimed is:

1. A storage unit for receiving, holding and displaying equipment including an elongate flexible member and an elongate substantially rigid member for convenient selection and removal, said unit comprising:

(a) a cabinet including a front side, a rear side, first and second spaced lateral sides, and a top for supporting said flexible member thereon;

(b) receiving means for receiving said flexible member, said receiving means including (i) first retention means projecting above the top front edge of said cabinet, and (ii) second retention means projecting above the top rear edge of said cabinet, said first retention means and said second retention means being spaced apart to receive said flexible member therebetween;

(c) support means on said second retainer means for removably holding said rigid member; and (d) a plurality of hooks depending from said cabinet for supporting additional rigid members.

2. The storage unit of claim 1, wherein the top of said cabinet is generally arcuate having downturned terminal portions directed toward respective ones of said lateral sides.

3. The storage unit of claim 1 wherein said second retention means includes:

(a) first and second upright support members for receiving having flexible member thereagainst; and (b) cradle means carried by each of said upright supports for supporting said rigid member.

4. A storage unit for receiving, holding and displaying cleaning equipment for convenient selection and removal, the cleaning equipment including a flexible hose, a cleaning implement having an elongate, substantially rigid portion, and an accessory for attachment to said flexible hose, said accessory having a substantially rigid coupling portion with an outwardly biased detent element, said storage unit comprising:

(a) a cabinet including a front side, a rear side, first and second spaced lateral sides, and a top for supporting said flexible hose thereon;

(b) first and second spaced apart retention means upstanding from said cabinet for receiving said flexible hose therebetween;

(c) support means for removably holding said rigid portion of said cleaning implement;

(d) coupling means carried in said cabinet for receiving and engageably holding the coupling portion of said accessory; and (e) at least one hook depending from said cabinet for supporting at least one additional cleaning implement.

5. The storage unit of claim 4, wherein said first and second retention means are carried proximate the front side and the rear side, respectively, of said cabinet.

6. The storage unit of claim 5, wherein said first retention means comprises a flange projection above the top of said cabinet.

7. The storage unit of claim 6, wherein said second retention means comprises first and second upright support members for receiving said flexible member thereagainst.

8. The storage unit of claim 7, wherein said support means comprises cradle means carried by each of said upright support members for supporting said rigid portion of said cleaning implement.

9. The storage unit of claim 8, wherein said cradle means comprises a pair of fingers extending upwardly and forwardly from each of said support members, said fingers being vertically spaced apart to receive said rigid portion therebetween.

10. A storage unit for receiving, holding and displaying equipment including an elongate flexible member and an elongate substantially rigid member for convenient selection and removal, said unit comprising:

(a) a cabinet including a front side, a rear side, first and second spaced lateral sides, and a top for supporting said flexible member thereon;

(b) receiving means for receiving said flexible member, said receiving means including (i) first retention means projecting above the top front edge of said cabinet, and (ii) second retention means projecting above the top rear edge of said cabinet, said first retention means and said second retention means being spaced apart to receive said flexible member therebetween;

(c) support means on said second retainer means for removably holding said rigid member; and (d) coupling means carried in said cabinet for receiving and engageably holding a downwardly projecting tubular attachment element having a substantially rigid coupling portion with an outwardly biased detent element.

11. The storage unit of claim 10, wherein:

(a) said cabinet further includes a shelf having a topside and an underside; and (b) said coupling means includes an opening in said shelf for receiving the coupling portion of said attachment member therethrough with said detent element projecting over the topside of said shelf.

12. The storage unit of claim 11, wherein said coupling means further comprises an outwardly downwardly beveled surface for depressing the detent member of said attachment member for passage through said opening in response to movement of said coupling portion in a direction from the underside to the topside of said shelf.

13. The storage unit of claim 11, further including a removable element carried within said opening for substantial continuity of the topside of said panel prior to initial receipt of said coupling portion through said opening.

14. A storage unit for receiving, holding and displaying cleaning equipment for convenient selection and removal, the cleaning equipment including a flexible hose, a cleaning implement having an elongate, substantially rigid portion, and an accessory for attachment to said flexible hose, said accessory having a substantially rigid coupling portion with an outwardly biased detent element, said storage unit comprising (a) a cabinet including a front side, a rear side, first and second spaced lateral sides, a top for supporting said flexible hose thereon, and a shelf having a topside and an underside;

(b) first and second spaced apart retention means upstanding from said cabinet for receiving said flexible hose therebetween;

(c) support means for removably holding said rigid portion of said cleaning implement;

(d) coupling means carried in said cabinet for receiving and engagably holding the coupling portion of said accessory, said coupling means including an opening in said shelf for receiving the coupling portion of said attachment member therethrough with said detent element projecting over the topside of said shelf.

15. The storage unit of claim 14, wherein said coupling means further comprises an outwardly downwardly beveled surface for depressing the detent member of said attachment member for passage through said opening in response to movement of said coupling portion in a direction from the underside to the topside of said shelf.

* * * * *

UNITED STATES PATENT AND TRADEMARK OFFICE

CERTIFICATE OF CORRECTION

PATENT NO. : 4,906,058

DATED : March 6, 1990

INVENTOR(S) : Robert A. Turner

It is certified that error appears in the above—identified patent and that said Letters Patent is hereby corrected as shown below:

In the Title Page:

Change "[76] Inventor: Robert A. Turner, 17 E. Berridge Ln. Rear, Phoenix, Ariz. 85016" to --[76] Inventor: Robert A. Turner, 1724 E. Berridge Ln. Rear, Phoenix, Arizona 85016--.

Signed and Sealed this

Nineteenth Day of March, 1991

*Attest:*

HARRY F. MANBECK, JR.

*Attesting Officer*

*Commissioner of Patents and Trademarks*